US009326569B1

(12) United States Patent
Cipolla

(10) Patent No.: US 9,326,569 B1
(45) Date of Patent: May 3, 2016

(54) JEWELRY CLASP

(71) Applicant: Steven A. Cipolla, Cranston, RI (US)

(72) Inventor: Steven A. Cipolla, Cranston, RI (US)

(73) Assignee: National Chain Company, Warwick, RI (US)

( * ) Notice: Subject to any disclaimer, the term of this patent is extended or adjusted under 35 U.S.C. 154(b) by 134 days.

(21) Appl. No.: 14/186,053

(22) Filed: Feb. 21, 2014

(51) Int. Cl.
*A44C 5/20* (2006.01)

(52) U.S. Cl.
CPC ..... *A44C 5/2066* (2013.01)

(58) Field of Classification Search
None
See application file for complete search history.

(56) References Cited

U.S. PATENT DOCUMENTS 4,358,876 A 11/1982 Colognori
4,958,420 A 9/1990 Bunz
5,642,558 A 7/1997 Bodkin, Sr.
5,653,009 A 8/1997 Kassardjian
6,349,453 B1 2/2002 Nicoletti et al.
6,481,069 B1 11/2002 Cheng
6,804,868 B2 10/2004 Fox
7,353,665 B2 4/2008 Richardson
7,503,187 B2 3/2009 Richardson
7,966,704 B2 6/2011 Yurman et al.

FOREIGN PATENT DOCUMENTS

DE 4323673 A1 * 1/1995 ..... A44C 11/02

* cited by examiner

*Primary Examiner* — Jack W Lavinder
(74) *Attorney, Agent, or Firm* — Salter & Michaelson

(57) ABSTRACT

A clasp for releasably holding opposed ends of an elongated filament element. The clasp includes a housing having opposed sides each having a receiving port for accommodating respective opposed ends of the elongated filament element, and an open center chamber, a slide member received in the open center chamber of the housing, including opposed walls that each have a locking aperture, having an open center passage, and an end actuation button having locked and released positions, a locking disc engaged between the slide member and housing, and a spring disposed within the open center passage of the slide member and positioned between the locking disc and the end actuation button.

25 Claims, 6 Drawing Sheets

JEWELRY CLASP

FIELD OF THE INVENTION

The present invention relates in general to a jewelry clasp and pertains, more particularly, to an improved jewelry clasp that enables opposed swivel action as ready release of the jewelry clasp.

BACKGROUND OF THE INVENTION

There are a variety of different types of jewelry clasps that exist in the prior art. However, there still remains a need for a jewelry clasp that provides opposed swivel action while still enabling a ready release and securing at the jewelry clasp.

The following are some examples of prior art jewelry clasps. U.S. Pat. No. 7,503,187 to Richardson describes a clasp for releasably fastening two objects but does not provide opposed end connections nor opposed swiveling. U.S. Pat. No. 6,481,069 to Cheng describes a jewelry clasp used to secure a jewelry piece to an individual. In this patent the clasp includes a female part attached to one end of the piece of jewelry that has a latch pivotally mounted within a recess on the female part. This clasp does not provide for the opposed end swiveling action nor the single release arrangement as in accordance with the present invention. U.S. Pat. No. 5,653,009 to Kassardjian describes a claps for connecting the ends of a jewelry member but the connections are not at opposed ends and there is not provided the swiveling action as in accordance with the present invention. U.S. Pat. No. 7,966,704 to Yurman describes a jewelry clasp with a release member but does not have opposed end swiveling.

Accordingly, it is an object of the present invention to provide an improved jewelry clasp and one that in particular enables swiveling action at both ends of the clasp.

Another object of the present invention is to provide an improved jewelry clasp including a release button feature that is readily accessible and that enables ready release of one side of the clasp as well as ready re-engagement.

SUMMARY OF THE INVENTION

To accomplish the foregoing and other objects, features and advantages of the present invention there is provided a clasp for releasably holding opposed ends of an elongated filament element. The clasp includes a housing including opposed sides each having a receiving port for accommodating respective opposed ends of the elongated filament element, and an open center chamber; a slide member received in the open center chamber of the housing, including opposed walls that each have a locking aperture, having an open center passage, and an end actuation button having locked and released positions; a locking disc engaged between the slide member and housing; a spring disposed within the open center passage of the slide member and positioned between the locking disc and the end actuation button; said spring constructed and arranged to bias the slide member and end actuation button to the locked position.

In accordance with other aspects of the present invention the receiving ports are each circular ports and the housing has an annular shape; the open chamber has internal opposed flat surfaces, and the slide member also has opposed flat surfaces meant to engage with the flat surfaces within the open chamber so that the slide member is rotationally fixed; the respective flat surfaces are arranged to align the locking apertures of the slide member with respective receiving ports of the housing; each locking aperture has an enlarged portion and contiguous smaller portion; wherein, in the released position, the actuation button is positioned so that the end of an elongated filament element is aligned with the enlarged portion of the locking aperture; wherein, in the locked position, the actuation button is positioned so that the end of an elongated filament element is aligned with the smaller portion of the locking aperture; each elongated filament element end has an end annular slot; wherein, in both locked and released positions, one of the elongated filament element ends is locked by means of engagement of the locking disc with the annular slot of the one elongated filament element end; wherein, in the released position, the other end of the elongated filament element is positioned so that the end of an elongated filament element is aligned with the enlarged portion of the locking aperture and free of locking by the slide member; wherein, in the locked position, the other end of the elongated filament element is positioned so that the end of an elongated filament element is aligned with the smaller portion of the locking aperture and thus locked by engagement with the smaller portion of the locking aperture of the slide member; the locking disc includes a head disc for engagement with the housing and a locking leg member extending from the locking disc and for engagement with the one end of the elongated filament element; each locking aperture has an enlarged portion and contiguous smaller portion; wherein, in the released position, the actuation button is positioned so that the end of an elongated filament element is aligned with the enlarged portion of the locking aperture; wherein, in the locked position, the actuation button is positioned so that the end of an elongated filament element is aligned with the smaller portion of the locking aperture; and wherein the locking leg member includes a forked leg construction extending toward a base of the housing and the actuation button.

In accordance with the present invention there is also provided a clasp for releasably holding and in combination with opposed ends of an elongated filament element, with each end of the elongated filament element having an end annular slot for locking. The clasp includes a housing including opposed sides each having a receiving port for accommodating respective opposed ends of the elongated filament element, and an open center chamber; a slide member received in the open center chamber of the housing, including opposed walls that each have a locking aperture, having an open center passage, and an end actuation button having locked and released positions; said locking aperture for selective engagement with one of said annular slots; a spring disposed within the open center passage of the slide member and positioned for biasing the end actuation button; and said spring constructed and arranged to bias the slide member and end actuation button to the locked position.

In accordance with still other aspects of the present invention including a locking disc engaged between the slide member and housing; wherein each locking aperture has an enlarged portion and contiguous smaller portion, wherein, in the released position, the other end of the elongated filament element is positioned so that the end of an elongated filament element is aligned with the enlarged portion of the locking aperture and free of locking by the slide member, and wherein, in the locked position, the other end of the elongated filament element is positioned so that the end of an elongated filament element is aligned with the smaller portion of the locking aperture and thus locked by engagement with the smaller portion of the locking aperture of the slide member; wherein, in both locked and released positions, one of the elongated filament element ends is locked by means of engagement of the locking disc with the annular slot of the one elongated filament element end.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
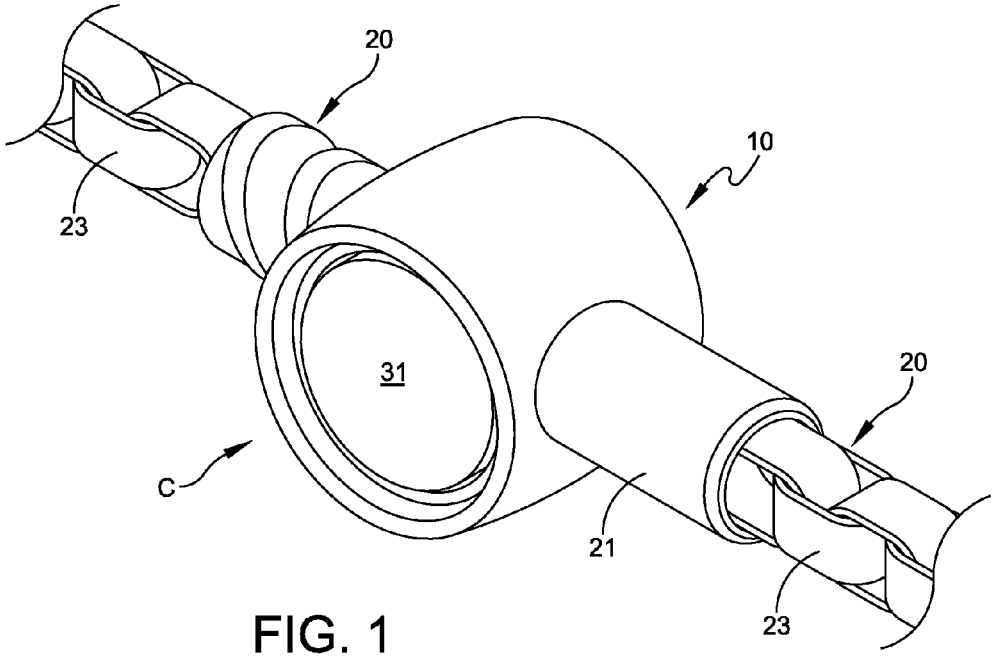
FIG. 1 is a fragmentary perspective view showing the clasp with opposed ends of the decorative chain attached thereto.

The present invention relates to a clasp that is for releasably holding opposed ends of an elongated chain or cord. In, for example, FIGS. 1 and 2, there is illustrated a fragmentary perspective view of the clasp C that is adapted to interconnect opposed ends of a chain or the like. This chain or cord is described herein as a filament element and may take on many different forms. In the drawings this is illustrated as filament element ends 20 which each include an enlarged portion 21. The overall clasp and filament element is meant to form a necklace or bracelet or the like and thus the filament is considered as being formed in a loop with the respective ends 21.

Figure 2:
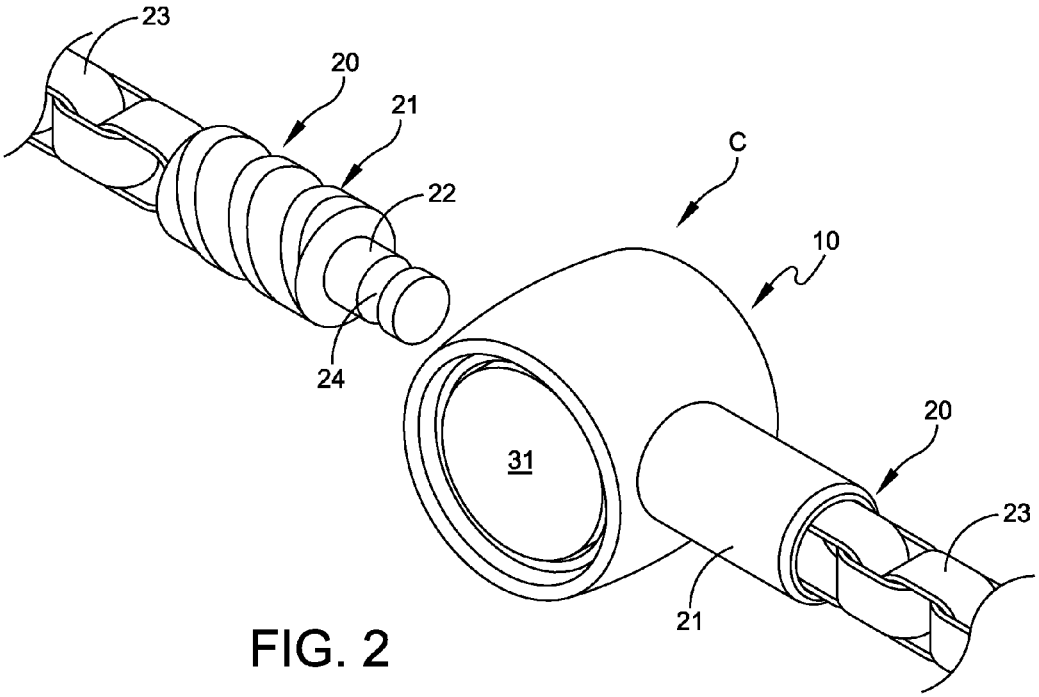
FIG. 2 is a fragmentary perspective view similar to that shown in FIG. 1 illustrating one of the ends of the jewelry chain released.

In the embodiment that is described herein, the filament element is in the form of a chain having links 23. However, many other different forms of a filament element may be employed. Also illustrated in the drawings are the enlarged ends 21. One of these ends 21 is cylindrical in form and the other end 21 may have a spiral groove. This spiral groove is used for the purpose of accommodating a charm base that can be screwed onto the grooved end once that end is released from the clasp housing 10. FIG. 1 illustrates the grooved end 20 attached to the housing 10 while FIG. 12 illustrates the grooved end 20 having been released or detached from the housing 10. The clasp C provides an effective and simple means by which the attachment with the filament ends can be released and locked.

The filament ends, in addition to the enlarged portion 21, also include a smaller shaft 22 having an annular groove 24. This arrangement is used for locking the filament ends with the housing 10 of the clasp. This locking and releasing arrangement is discussed in further detail in connection with other figures described herein such as in FIGS. 3-8.

Figure 4:
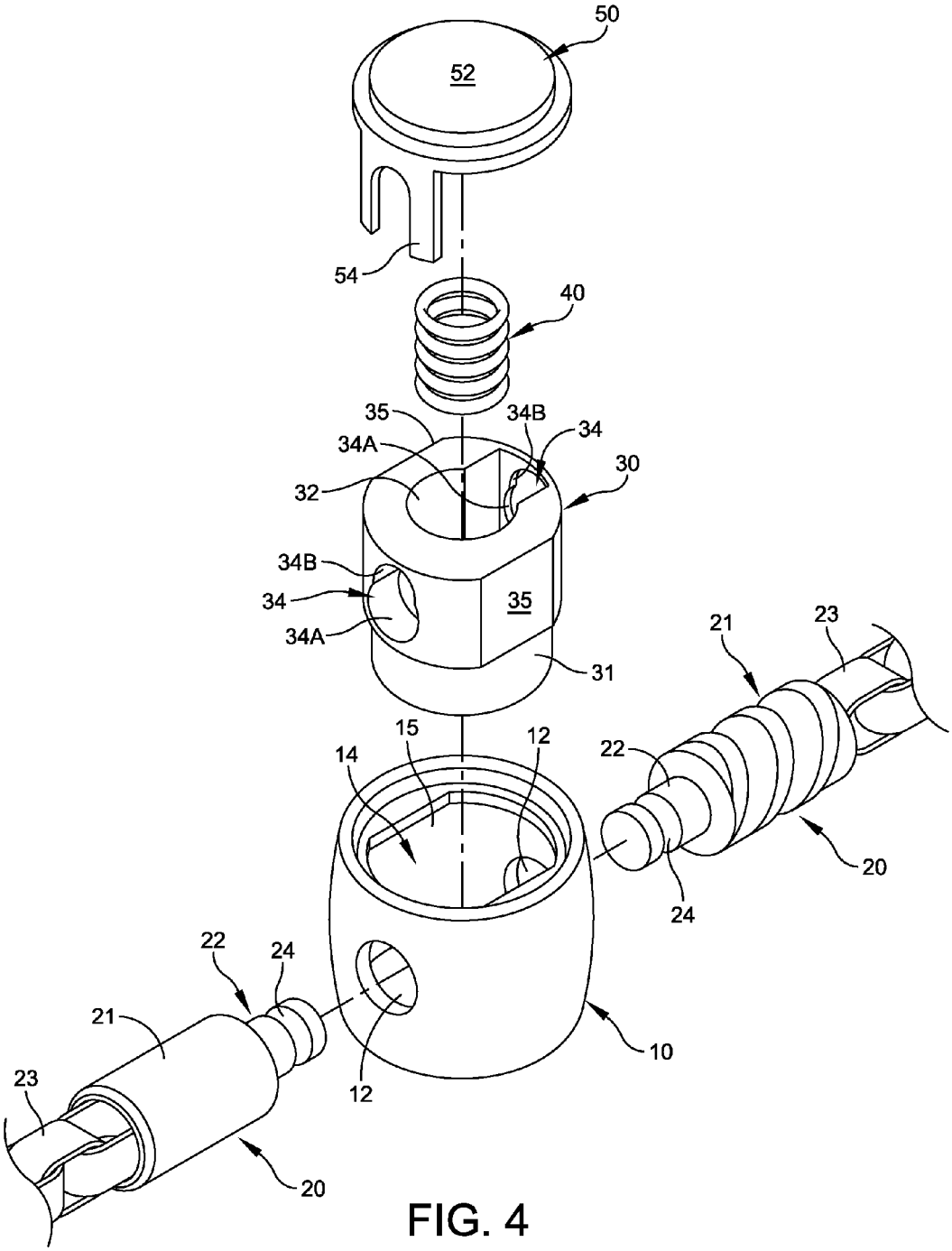
FIG. 4 is a further exploded perspective view showing the various components.

The clasp C that is described herein includes a housing 10 that is generally cylindrical in shape having opposed sides with a receiving port 12. Refer, for example, to the exploded perspective view of FIG. 4 showing the housing 10 and receiving ports 12. These receiving ports 12 are for accommodating respective opposed ends 22 of the elongated filament element. In a preferred embodiment the housing 10 is substantially cylindrical although it may have a somewhat arcuate cross-sectional outer surface such as illustrated in the cross-sectional views of FIGS. 7 and 8. The peripheral wall of the housing 10 defines an open center chamber 14.

Figure 3:
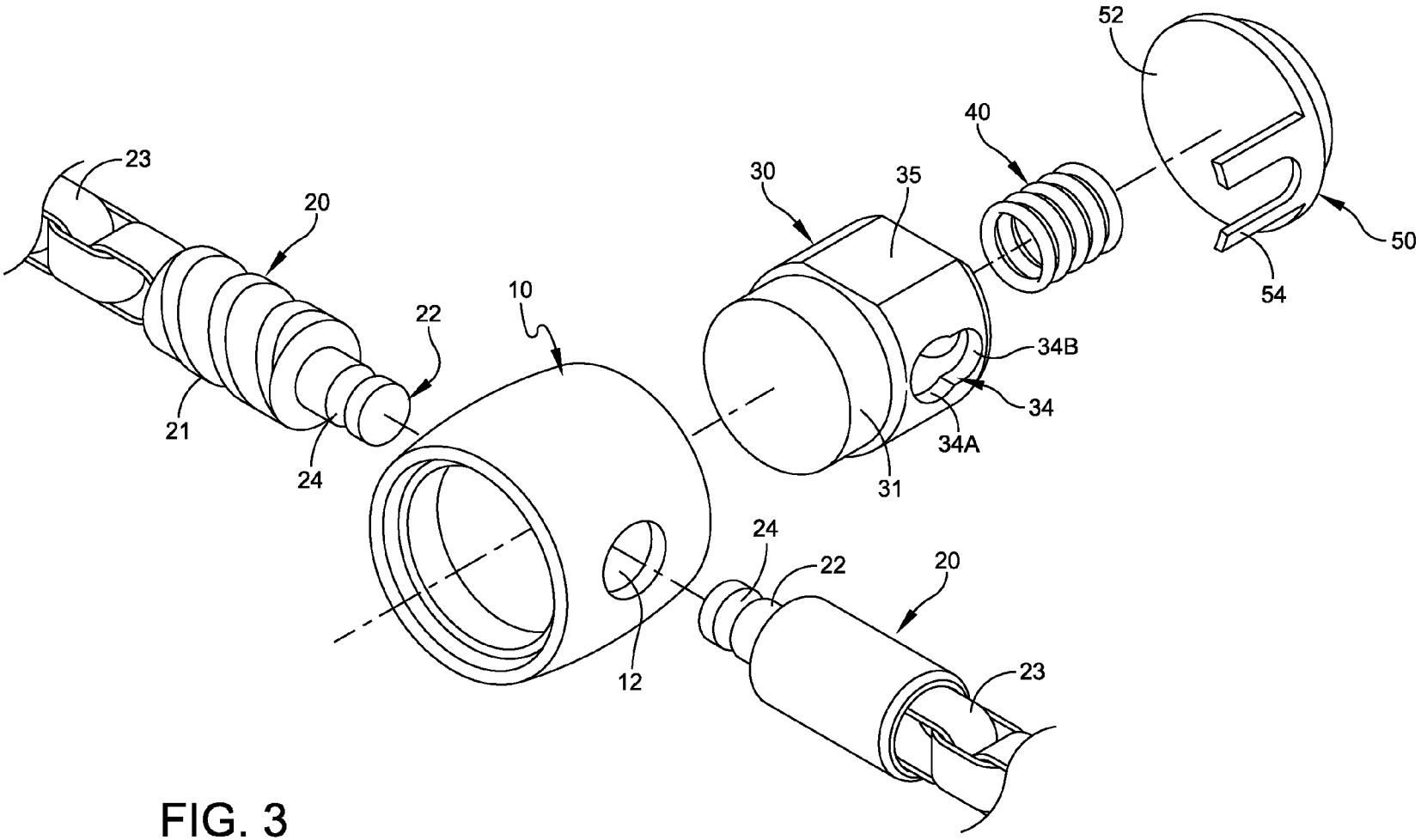
FIG. 3 is an exploded perspective view illustrating the components of the jewelry clasp.
Figure 5:
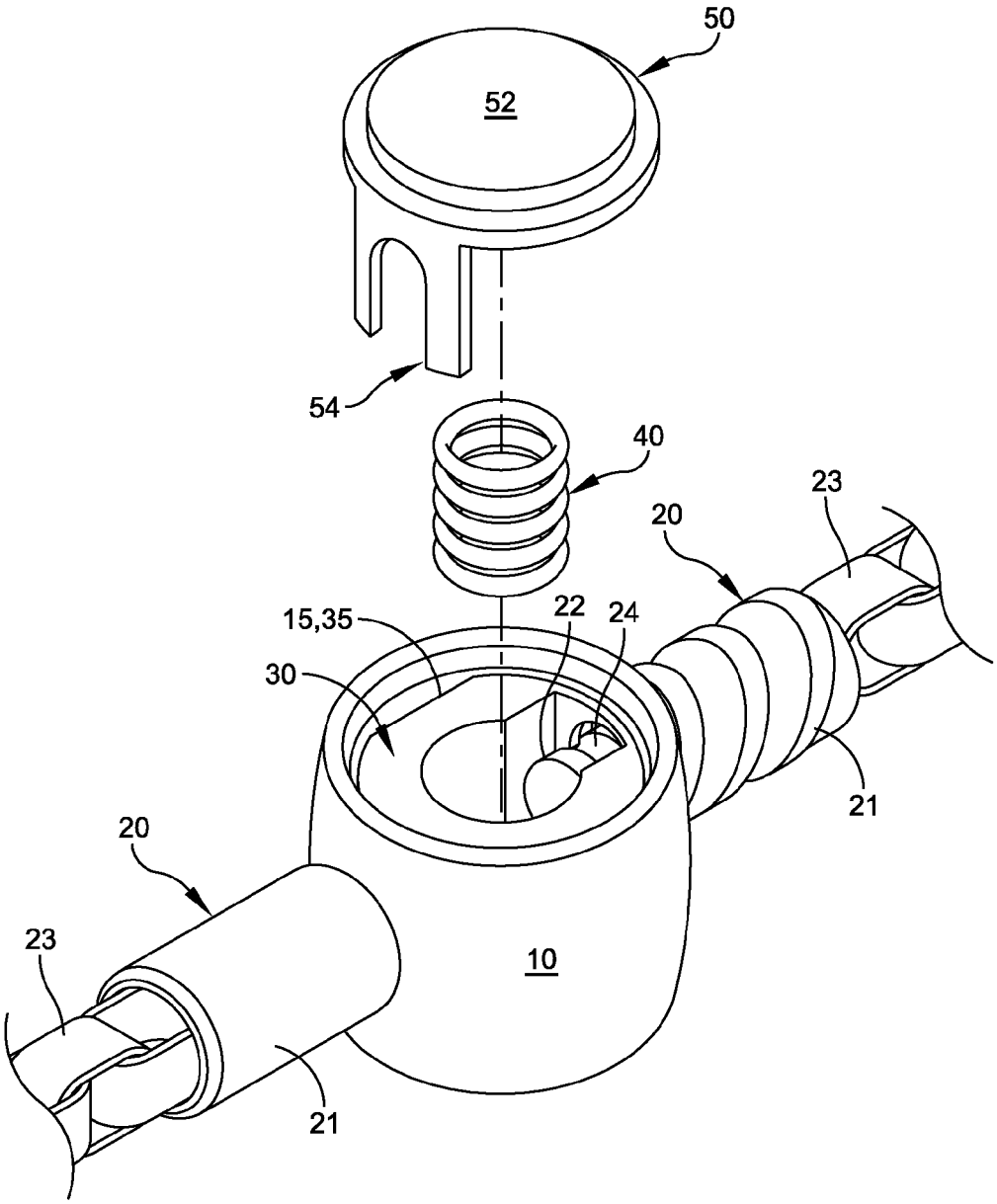
FIG. 5 is a perspective view showing some of the components of the clasp exploded away from the housing.

Referring now to FIGS. 3-5, the clasp also includes a slide member 30 that is adapted to be received within the open center chamber 14 of the housing 10. FIG. 4 illustrates the slide member 30 exploded away from the housing 10 while FIG. 5 illustrates the slide member 30 positioned within the open center chamber of the housing 10. The slide member 30 may also be considered as of substantially cylindrical shape with opposed sides thereof each having a locking aperture 34. The slide member 30 also has an open center passage 32. One end of the slide member 30 forms a substantially cylindrical end actuation button that may be considered as providing the means by which the clasp can either assume locked or released positions. The locked position is illustrated in the cross-sectional view of FIG. 7 while the released position is illustrated in the cross-sectional view of FIG. 8. FIGS. 3-5 also illustrate the locking disk 50. This includes a locking leg 54 that is engaged between the slide member and the housing. A spring 40 is disposed within the open center passage of the slide member 30 and is positioned between the locking disc 50 and the end actuation button 31, as illustrated in the cross-sectional views of FIGS. 7 and 8. The spring 40 is a coil spring and is constructed and arranged to bias the slide member 30 and the associated end actuation button normally toward the locked position thereof.

With respect to the construction of the housing 10, it is noted that the receiving ports 12 are illustrated as substantially circular in shape while the housing itself has a generally annular shape. The open center chamber 14 is provided with internal opposed flat surfaces 15. These surfaces are used in combination with the configuration of the slide member 30, to register the slide member 30 with the housing 10 in the position where the receiving ports 12 essentially align with the locking apertures 34. For this purpose, the slide member 30 also has opposed flat surfaces 35 that are meant to engage with the flat surfaces 15 within the open chamber so that there is proper alignment of the slide member with the housing and so that the slide member is essentially rotationally fixed in position while being maintained slidable within the housing. Thus, these respective flat surfaces on the slide member and housing are arranged to align the locking apertures of the slide member with the respective receiving ports of the housing.

With respect to each of the locking apertures, it is noted that it has a somewhat pear-shaped configuration with contiguous circular portions including an enlarged portion 34A and a smaller portion 34B. In the released position, the actuation button 31 is positioned so that the end of an elongated filament element is aligned with the enlarged portion of the locking aperture enabling release of the elongated filament from the clasp. On the other hand, in the lock position the actuation button 31 is positioned so that the end of the elongated filament element is aligned with the smaller portion of the locking aperture thus locking the elongated filament element in position.

As indicated previously, the elongated filament element has at each end a locking slot 24. Thus, for the end of the elongated filament element that is to be released, it is positioned so that, in the released position, the end of the elongated filament element is aligned with the enlarged portion of the locking aperture and thus releasable from the housing. On the other hand, in the lock position, the elongated filament element is positioned so that the end thereof is aligned with the smaller portion of the locking aperture and thus locked by engagement with the smaller portion of the locking aperture in the annular slot 24.

With respect to the locking disc 50, it may be considered as including a substantially circular head disc 32. This is for engagement with the housing 10. The locking disc further includes a locking leg member 54 extending from the head disc and for engagement with one end of the elongated filament element. The locking leg member includes a forked leg construction providing a U-shaped opening. The locking leg member extends from the head disc toward a base of the housing and toward the actuation button. The leg member 54 engages the slot 24 to maintain a fixed and substantially permanent coupling of that end of the elongated filament element with the housing 10.

Figure 6:
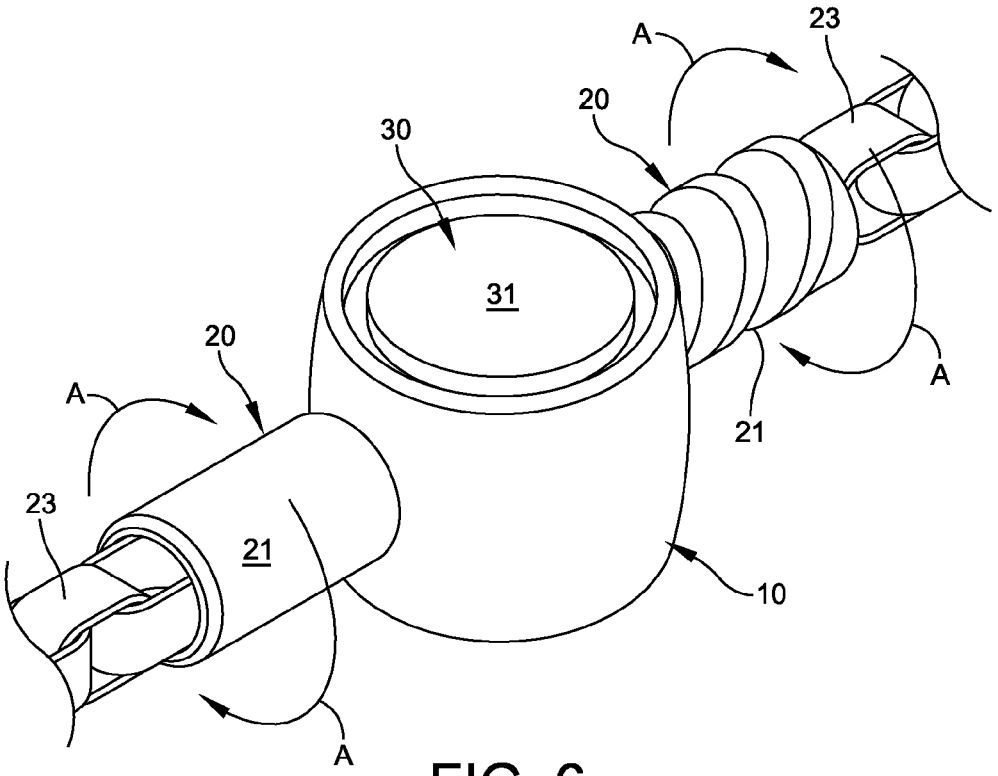
FIG. 6 is a fragmentary exploded view showing the release button side of the clasp.

FIG. 4 is a perspective view with the components of the clasp fully exploded away from the housing. FIG. 5 is a similar perspective view showing the slide member 30 disposed within the open center chamber 14 of the housing 10. In FIG. 5 the spring 40 and the locking disc 50 are shown exploded away from the housing 10. In FIG. 5 the end 22 of the elongated filament is illustrated so that the annular slot 24 is aligned with the locking aperture. FIG. 6 is a fragmentary view taken in the opposite direction illustrating, at the opposite end of the housing, the position of the actuation button 31. FIG. 6 also illustrates by arrows A one important aspect of the present invention which is the fact that the construction of the ends of the filament member and housing components are such that there is relatively ready rotation in the direction of arrows A of the ends of the filament element with the opposed sides of the clasp housing 10.

Reference is now again made to the perspective view of FIG. 5 which illustrates the slide member 30 disposed in position with the flat surfaces 15, 35 engaged so that the locking aperture is in alignment with the housing ports. In that position, the slide member 30 is provided with a step, at 62 in FIGS. 7 and 8, that engages a flange 64 on the inside of the housing 10. This arrangement limits the extent to which the actuation button 31 extends from the housing. This extended position is shown in the cross-sectional view of FIG. 7.

Figure 7:
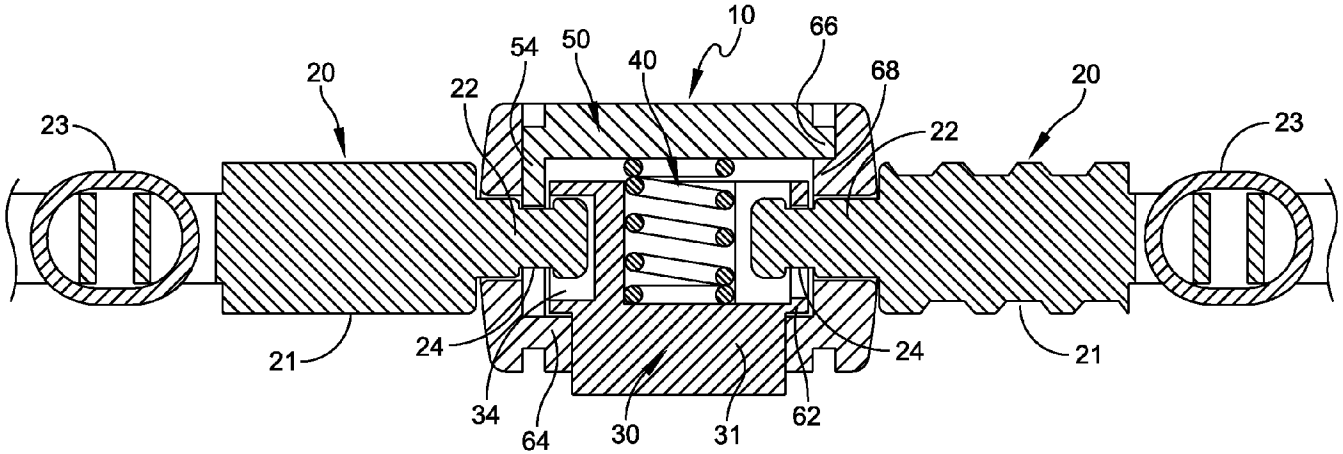
FIG. 7 is a cross-sectional view taken through the jewelry chain and clasp with the clasp in its locked position.
Figure 8:
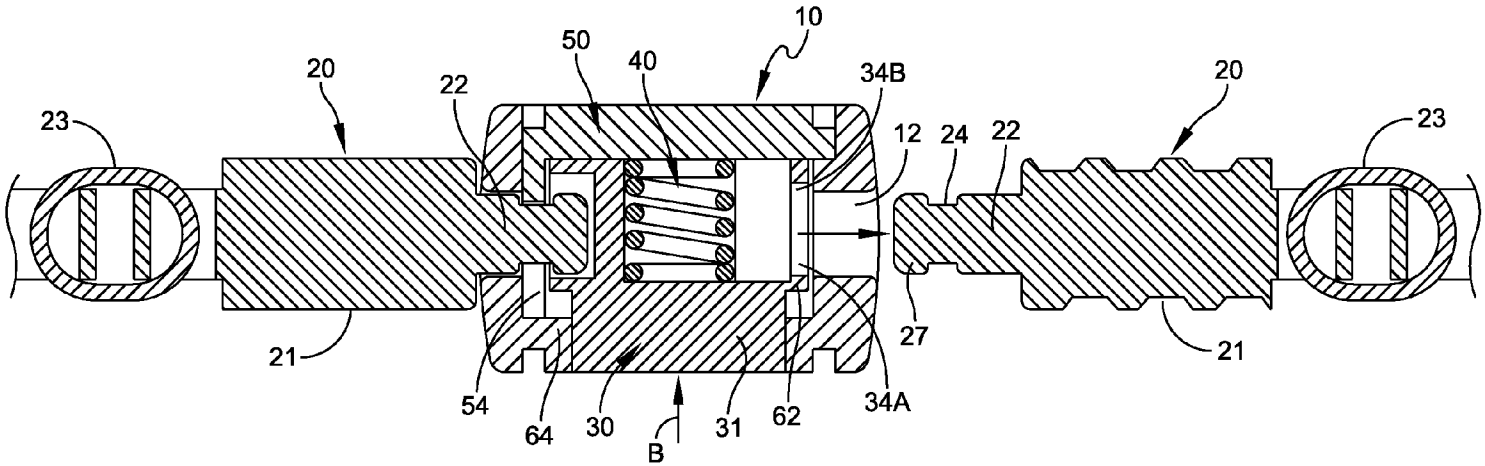
FIG. 8 is a cross-sectional view through the jewelry chain and clasp with the clasp in its released position.

After the slide member 30 is in position, in the construction of the clasp, the spring 40 and locking disc 50 are then inserted into the position such as illustrated in FIGS. 7 and 8. The locking legs 54 of the locking disc provide a diameter between the legs that is sufficient to engage the slot 24 at the end 22 of the elongated filament element. This engagement is illustrated in FIG. 7 by the base of the legs engaging directly into the slot 24 at the reduced diameter end 22 of the filament element. The locking disc 50 is preferably firmly engaged with the housing. This may occur by means of a force fit or other securing member. The positioning of the locking member may be delimited by contact of a portion of the locking member 50 at 66 with a step 68 internally of the housing. Refer to the cross-sectional view of FIG. 7. Thus, in the cross-sectional view of FIG. 7, the end of the filament element to the left of the clasp housing is engaged through one of the receiving ports 12, extends within the locking aperture 34 and is secured in a fixed position relative to the housing by means of the locking leg 54 engaging with the slot 24.

On the right-hand side of the housing illustrated in FIG. 7, it is noted that the opposite end of the elongated filament element is locked in position. This end extends through the receiving port 12 of the housing and is locked by means of engagement with the smaller portion 34B of the locking aperture 34. This is shown at 62 in FIG. 7 wherein the portion 34B of the locking aperture engages the slot 24 and essentially locks the elongated filament element with the clasp housing. In this position, it is noted that the spring 40 is urging the slide member 30 to a downward position wherein there is engagement at 62, 64 thus holding the clasp in the normally locked position under bias of the spring 40.

Reference is now made to the cross-sectional view of FIG. 8 which represents a released position of the clasp. This occurs by the user depressing the actuation button 31 in the direction of arrow B in FIG. 8. This movement causes only the slide member 30 to move upwardly until it rests against the inner surface of the locking disc 50. This has the effect of moving the larger diameter portion 34A of the locking aperture into alignment with the receiving port 12. The larger diameter portion 34B has a diameter that is slightly larger than the diameter of the end 27 shown in the cross-sectional view of FIG. 8. Thus, upon movement of the actuation button 31, the user is able to disengage one end of the elongated filament element. In order to re-engage that end of the filament element, the button 31 may be again depressed to properly align the larger diameter portion of the locking aperture with the receiving port of the housing. It is then possible to again insert the elongated filament element end into the housing to the position illustrated in FIG. 7. Upon release of the actuation button by the user, the clasp and filament element are then in the locked position as illustrated in FIG. 7.

Having now described certain embodiments of the present invention, it should be apparent to those skilled in the art that numerous other embodiments and modifications thereof are contemplated as falling within the scope of the present invention. For example, in FIG. 4 the slide member 30 is illustrated as having like locking apertures on both sides with the aforementioned different diameter portions. With respect to the views shown in FIGS. 7 and 8, on the left-hand side of the housing, the locking aperture need not have this dual diameter configuration in that the locking on that side of the housing occurs by means of the locking disc and not the slide member. The slide member is to have a sufficient aperture 34 so that the slide member 30 can transition between the two different positions shown in FIGS. 7 and 8. Thus, the locking aperture on that side of the housing may be constructed of only a larger diameter.

What is claimed is:

1. A clasp for releasably holding opposed ends of an elongated filament element, comprising:

a housing including opposed sides each having a receiving port for accommodating respective opposed ends of the elongated filament element, and an open center chamber;

a slide member received in the open center chamber of the housing, including opposed walls that each have a locking aperture, having an open center passage, and an end actuation button having locked and released positions;

a locking disc engaged between the slide member and housing;

a spring disposed within the open center passage of the slide member and positioned between the locking disc and the end actuation button;

said spring constructed and arranged to bias the slide member and end actuation button to the locked position;

wherein each elongated filament element end has an end annular slot;

wherein, in both locked and released positions of the end actuation button, one of the elongated filament element ends is locked by means of engagement of the locking disc with the annular slot of the one elongated filament element end.

2. The clasp of claim 1 wherein the receiving ports are each circular ports and the housing has an annular shape.

3. The clasp of claim 2 wherein the open chamber has internal opposed flat surfaces, and the slide member also has opposed flat surfaces meant to engage with the flat surfaces within the open chamber so that the slide member is rotationally fixed.

4. The clasp of claim 3 wherein the respective flat surfaces are arranged to align the locking apertures of the slide member with respective receiving ports of the housing.

5. The clasp of claim 4 wherein each locking aperture has an enlarged portion and contiguous smaller portion.

6. The clasp of claim 5 wherein, in the released position, the actuation button is positioned so that the end of an elongated filament element is aligned with the enlarged portion of the locking aperture.

7. The clasp of claim 5 wherein, in the locked position, the actuation button is positioned so that the end of an elongated filament element is aligned with the smaller portion of the locking aperture.

8. The clasp of claim 1 wherein the open center chamber of the housing is defined by respective opposed end ports, one end port receiving the locking disc and the opposed end port receiving the end actuation button.

9. The clasp of claim 1 wherein each locking aperture has an enlarged portion and contiguous smaller portion.

10. The clasp of claim 9 wherein, in the released position, the actuation button is positioned so that the end of an elongated filament element is aligned with the enlarged portion of the locking aperture.

11. The clasp of claim 9 wherein, in the locked position, the actuation button is positioned so that the end of an elongated filament element is aligned with the smaller portion of the locking aperture.

12. A clasp for releasably holding opposed ends of an elongated filament element, comprising:

a housing including opposed sides each having a receiving port for accommodating respective opposed ends of the elongated filament element, and an open center chamber;

a slide member received in the open center chamber of the housing, including opposed walls that each have a locking aperture, having an open center passage and an end actuation button having locked and released positions;

a locking disc engaged between the slide member and housing;

a spring disposed within the open center passage of the slide member and positioned between the locking disc and the end actuation button;

said spring constructed and arranged to bias the slide member and end actuation button to the locked position;

wherein the receiving ports are each circular ports and the housing has an annular shape;

wherein the open chamber has internal opposed flat surfaces, and the slide member also has opposed flat surfaces meant to engage with the flat surfaces within the open chamber so that the slide member is rotationally fixed;

wherein the respective flat surfaces are arranged to align the locking apertures of the slide member with respective receiving ports of the housing;

wherein each locking aperture has an enlarged portion and contiguous smaller portion;

wherein, in the locked position, the actuation button is positioned so that the end of an elongated filament element is aligned with the smaller portion of the locking aperture;

wherein each elongated filament element end has an end annular slot;

wherein, in both locked and released positions, one of the elongated filament element ends is locked by means of engagement of the locking disc with the annular slot of the one elongated filament element end.

13. The clasp of claim 12 wherein, in the released position, the other end of the elongated filament element is positioned so that the end of an elongated filament element is aligned with the enlarged portion of the locking aperture and free of locking by the slide member.

14. The clasp of claim 13 wherein, in the locked position, the other end of the elongated filament element is positioned so that the end of an elongated filament element is aligned with the smaller portion of the locking aperture and thus locked by engagement with the smaller portion of the locking aperture of the slide member.

15. The clasp of claim 14 wherein the locking disc includes a head disc for engagement with the housing and a locking leg member extending from the locking disc and for engagement with the one end of the elongated filament element.

16. The clasp of claim 15 wherein the locking leg member includes a forked leg construction extending toward a base of the housing and the actuation button.

17. A clasp for releasably holding opposed ends of an elongated filament element, comprising:

each end of the elongated filament element having an end annular slot for locking;

a housing including opposed sides each having a receiving port for accommodating respective opposed ends of the elongated filament element, and an open center chamber;

a slide member received in the open center chamber of the housing, including opposed walls that each have a locking aperture, having an open center passage, and an end actuation button having locked and released positions;

said locking aperture for selective engagement with one of said annular slots;

a spring disposed within the open center passage of the slide member and positioned for biasing the end actuation button;

said spring constructed and arranged to bias the slide member and end actuation button to the locked position;

wherein each locking aperture has an enlarged portion and contiguous smaller portion that together form a single pear-shaped aperture;

wherein, in the released position of the end actuation button, the actuation button is positioned so that the end of an elongated filament element is aligned with the enlarged portion of the locking aperture;

wherein, in the locked position of the end actuation button, the actuation button is positioned so that the end of an elongated filament element is aligned with the smaller portion of the locking aperture.

18. The clasp of claim 17 including a locking disc engaged between the slide member and housing.

19. The clasp of claim 17 wherein each locking aperture has an enlarged portion and contiguous smaller portion, wherein, in the released position, the other end of the elongated filament element is positioned so that the end of an elongated filament element is aligned with the enlarged portion of the locking aperture and free of locking by the slide member, and wherein, in the locked position, the other end of the elongated filament element is positioned so that the end of an elongated filament element is aligned with the smaller portion of the locking aperture and thus locked by engagement with the smaller portion of the locking aperture of the slide member.

20. A clasp for releasably holding opposed ends of an elongated filament element, comprising:

each end of the elongated filament element having an end annular slot for locking;

a housing including opposed sides each having a receiving port for accommodating respective opposed ends of the elongated filament element, and an open center chamber;

a slide member received in the open center chamber of the housing, including opposed walls that each have a locking aperture, having an open center passage, and an end actuation button having locked and released positions;

said locking aperture for selective engagement with one of said annular slots;

a spring disposed within the open center passage of the slide member and positioned for biasing the end actuation button;

said spring constructed and arranged to bias the slide member and end actuation button to the locked position;

including a locking disc engaged between the slide member and housing;

wherein each locking aperture has an enlarged portion and contiguous smaller portion, wherein, in the released position, the other end of the elongated filament element is positioned so that the end of an elongated filament element is aligned with the enlarged portion of the locking aperture and free of locking by the slide member and wherein, in the locked position, the other end of the elongated filament element is positioned so that the end of an elongated filament element is aligned with the smaller portion of the locking aperture and thus locked by engagement with the smaller portion of the locking aperture of the slide member;

wherein, in both locked and released positions, one of the elongated filament element ends is locked by means of engagement of the locking disc with the annular slot of the one elongated filament element end.

21. A clasp for releasably holding and in combination with opposed ends of an elongated filament element, comprising:

a housing including opposed sides each having a receiving port for accommodating respective opposed ends of the elongated filament element, and an open center chamber;

a slide member received in the open center chamber of the housing, including opposed walls that each have a locking aperture, having an open center passage, and an integral end actuation button having locked and released positions;

a separate locking disc engaged between the slide member and housing;

wherein the open center chamber of the housing is also defined by respective opposed end ports that are arranged substantially transverse to the receiving ports of the opposed sides of the housing, one end port receiving the locking disc and the opposed end port receiving the end actuation button;

each said locking aperture for selective alignment with an end of the elongated filament element;

a spring disposed within the open center passage of the slide member and positioned for biasing the end actuation button;

said spring supported between the end actuation button and the locking disc, and constructed and arranged to bias the slide member and end actuation button to the locked position.

22. The clasp of claim 21 wherein at least one of the locking apertures has an enlarged portion and contiguous smaller portion that together form a single pear-shaped aperture.

23. The clasp of claim 21 including a locking disc engaged between the slide member and housing.

24. The clasp of claim 23 wherein, in both locked and released positions, one of the elongated filament element ends is locked by means of engagement of the locking disc with the annular slot of the one elongated filament element end.

25. The clasp of claim 23 wherein the locking disc includes a head disc for engagement with the housing and a locking leg member extending from the locking disc and for engagement with the one end of the elongated filament element.

* * * * *